US005097648A

United States Patent [19]

Berner et al.

[11] Patent Number: 5,097,648

[45] Date of Patent: Mar. 24, 1992

[54] APPARATUS FOR EVACUATING AND CLOSING BAG PACKAGE

[75] Inventors: Joachim Berner, Esslingen-Mettingen; Norbert Buchner, Winnenden; Klaus Domke, Ditzingen; Manfred Reichert, Remshalden; Herbert Stotkiewitz, Bietigheim-Bissingen, all of Fed. Rep. of Germany

[73] Assignee: Robert Bosch GmbH, Stuttgart, Fed. Rep. of Germany

[21] Appl. No.: 651,822

[22] Filed: Feb. 7, 1991

[30] Foreign Application Priority Data

Apr. 26, 1990 [DE] Fed. Rep. of Germany ..... 4013273

[51] Int. Cl.[5] ..... B65B 31/02; B65B 51/10

[52] U.S. Cl. ..... 53/88; 53/512; 53/371.8; 53/374.8

[58] Field of Search ..... 53/88, 373.7, 374.8, 53/512, 510, 434, 371.8

[56] References Cited

U.S. PATENT DOCUMENTS

| | | | |
|---|---|---|---|
| 2,634,562 | 4/1953 | Mueller . | |
| 2,692,074 | 10/1954 | Mueller . | |
| 3,103,771 | 9/1963 | Grafingholt | 53/512 X |
| 3,469,364 | 9/1969 | Bischoff | 53/374.8 X |
| 3,939,624 | 2/1976 | Gidewall et al. | 53/386.1 X |
| 4,586,320 | 5/1986 | Takai et al. | 53/512 |
| 4,693,058 | 9/1987 | Kovacs | 53/374.8 X |

*Primary Examiner*—John Sipos
*Assistant Examiner*—Linda B. Johnson
*Attorney, Agent, or Firm*—Edwin E. Greigg; Ronald E. Greigg

[57] ABSTRACT

A bag evacuating and closing apparatus having two opposing jaws which face ends that move toward one another. The jaws encompass a top closure of a bag package to be sealed. The jaws have hollow spaces open toward one another which are surrounded by frames with sealing jaws disposed in the hollow spaces; the hollow spaces form a chamber that receives the top closure of the bag package. A sealing rib protrudes from one face end of the two frames and is interrupted in a middle region of the frame part at which the closure fold protrudes between the jaws. In this region, suction openings are disposed in the frame parts of both jaws; these suction openings pull two walls of the top closure tightly against the frame parts. After the top closure of the bag package has been tightly encompassed, air is extracted from the bag package by a vacuum, and subsequently, the top closure of the package is tightly sealed by the sealing jaws which form a sealing seam to close the upper end of the bag.

12 Claims, 2 Drawing Sheets

APPARATUS FOR EVACUATING AND CLOSING BAG PACKAGE

BACKGROUND OF THE INVENTION

The invention is based on an apparatus for evacuating and closing bag packages as defined hereinafter. In an apparatus of this type known for instance from FIG. 22 of U.S. Pat. No. 2,692,074, the flat top closure fold protruding from the bag package is encompassed by the jaws, and a suction conduit is created between the walls of the closure fold by the application of negative pressure to these walls; through this conduit, the air contained in the package is evacuated by suction. The sealing jaws are movable toward one another between the underside of the jaws and the shoulders of the bag package; after air has been removed by suction, the sealing jaws are pressed together to form a sealed seam at the top closure fold of the bag package. The known evacuating and closing apparatus has a disadvantage that during the evacuation of the bag package, atmospheric air pressure bears on the part of the top closure located between the jaws of the shoulder in the region of the sealing jaws; with negative pressure in the bag package, the two walls of the top closure fold are increasingly pressed together. Because the neck of the bag package is pressed together in this way, only a slight negative pressure can be generated in the bag. The attainable negative pressure depends on the formation of folds and wrinkles in the walls of the top closure of the bag package, and they form small channels through which the air can be removed by suction. However, these channels have a disadvantage that they cannot be sealed off completely during the sealing of the top closure, so that during subsequent storage of the bag packages, air and hence oxygen that damages the product can enter the bag package again.

OBJECT AND SUMMARY OF THE INVENTION

The evacuating and closing apparatus according to the invention has an advantage that the jaws, resting on the shoulders of the bag package, completely surround the top closure of the package, and the walls of the top closure rest flush on the portion of the jaw frame near them, and the middle portion of the walls are pulled apart by the suction openings, so that a channel in the top closure is kept open, through which a high vacuum can be generated in the bag package.

Advantageous features of the invention are disclosed hereinafter. The disposition of suction openings as recited herein is especially advantageous, because in bag packages with side folds, the side fold region in the top closure fold is pressed together. Atmospheric air pressure is also prevented from acting on the top closure if the bag package is resiliently pressed against the jaws as recited, so that its shoulders rest on the underside of the jaws.

With the bag evacuating and closing apparatus according to the invention, which is very simple and economical in its design, very low remnant oxygen values in the bag packages can be attained, if the packages have been filled beforehand in a protective gas atmosphere in accordance with the process described in German Offenlegungsschrift 15 86 113. Since the time needed for evacuating and closing bag packages may be longer than other processing operations, it may be practical to provide a plurality of bag evacuating and closing apparatuses in the same packaging machine. Such an arrangement can for instance be similar to the arrangement of evacuation chambers or other processing apparatus, for instance as shown in German Offenlegungsschrift 38 14 824 and German Offenlegungsschrift 38 30 009. The bag packages are delivered from the conveyor equipment of the packaging machine to the stations to which an evacuating and closing apparatus is assigned and which either are stationary or revolve with a conveyor; after evacuation and closure, the bag packages are returned from these stations to the conveyor apparatus.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 2:
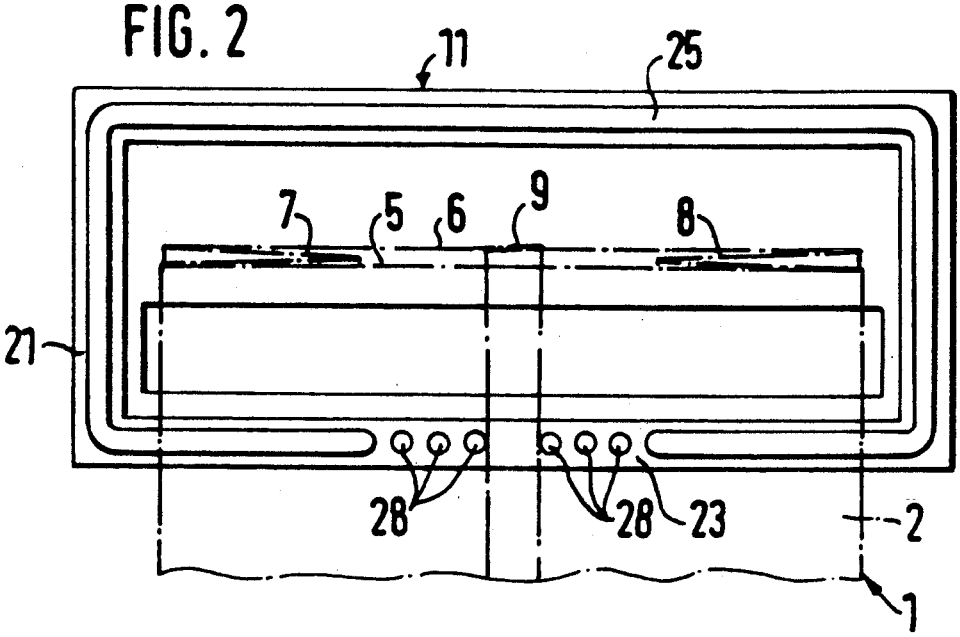
FIGS. 2 and 3 show a first and second jaw, respectively, of the apparatus of FIG. 1 in a front view.
Figure 3:
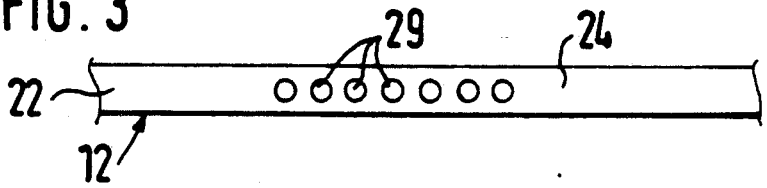
Figure 4:
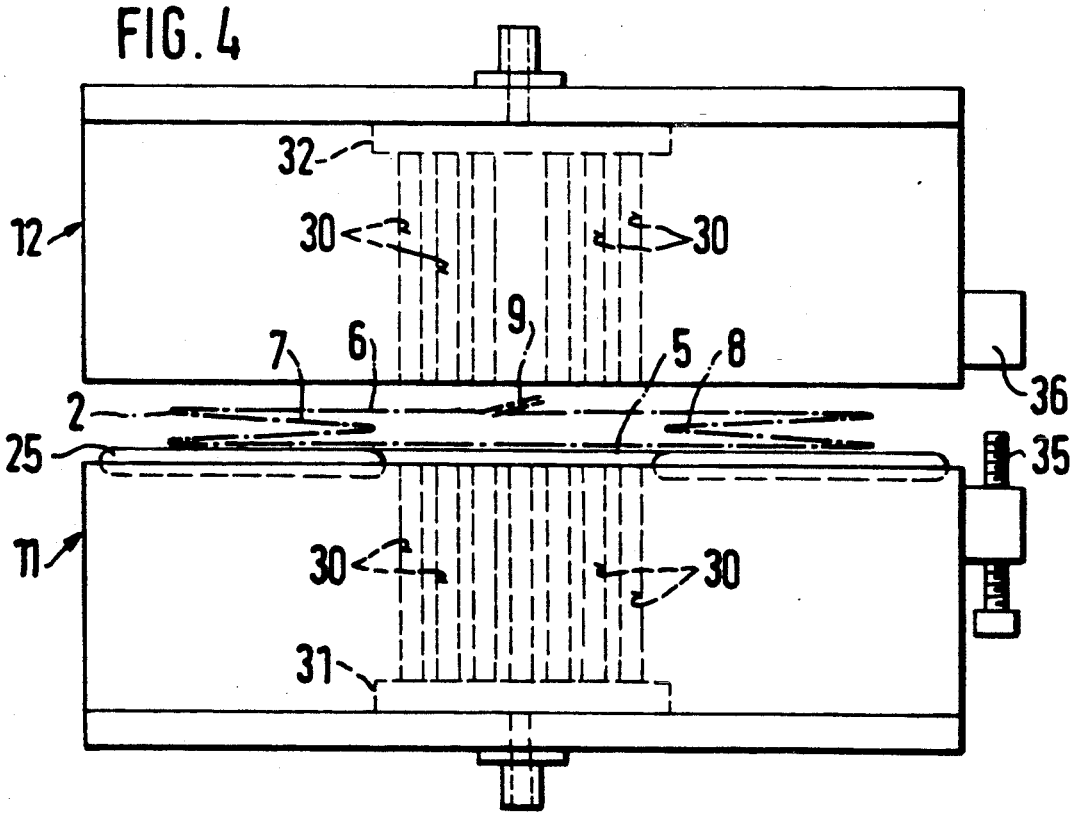
FIG. 4 shows the apparatus of FIG. 1 in a view from below.

The apparatus for evacuating and closing bag packages 1 has two semi-cylindrical jaws 11, 12 with a vertical contact plane; they are movable and pressable toward one another in the horizontal plane. For evacuation and sealing of bag packages 1, the bag top closure 2 is first folded flat in the manner of a fin, so that its upper end portion protrudes vertically upward away from shoulders 3 of the body 4 of the bag. In the exemplary embodiment of the bag package 1 shown, V-shaped side folds 7, 8, shown more clearly in FIGS. 2 and 4, are also folded inward between the two walls 5, 6 of the top closure 2, and a longitudinal seam 9, which is embodied as a fin seam and folded over extends in the middle of a side wall over the entire height of the bag package. The thus-prepared bag package 1, with its contents such as ground coffee made more compact by shaking, is moved in a conveyor bucket 14 of a conveyor apparatus (not shown) to beneath the jaws 11, 12, which initially are spaced apart from one another and the bag is raised by a spring bottom plate 15, so that the vertically protruding top closure 2 protrudes in between the two jaws 11, 12, and the shoulders 3 of the bag package 1 rest resiliently on the underside of the jaws. The two jaws 11, 12 are then pressed together, so that the top closure 2 is tightly encompassed.

Figure 1:
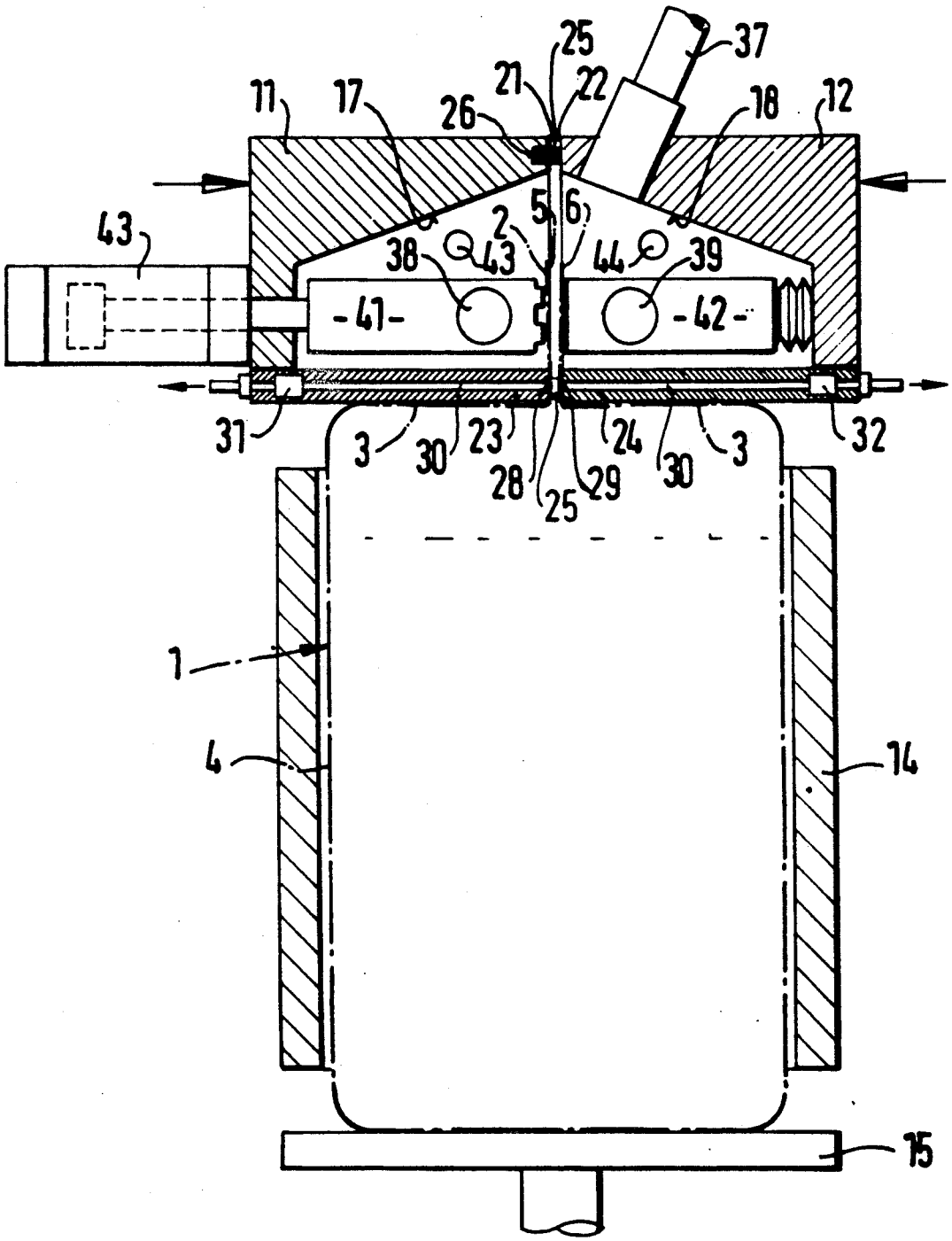
FIG. 1 shows a bag evacuating and closing apparatus in cross section.

The two jaws 11, 12 each have an open hollow space 17, 18 on their sides facing one another. Each of the openings of the hollow spaces 17, 18 is surrounded by a narrow rectangular frame 21, 22; the frames are congruent. While the face end of the frame 22 of one jaw 12 is flat, a resilient sealing rib 25, shown in FIGS. 1, 2, and 4, which is secured in a groove 26, protrudes from the face end of the frame 21 of the other jaw 11. This sealing rib 25 is not a continuous closed form like a frame but instead is interrupted in the middle portion of the lower frame part 23. In this middle portion of the lower frame part 23, a plurality of suction openings 28 discharge side by side. Symmetrically to suction opening 28, such openings 29 located close together in a row discharge in the middle region of the lower frame part 24 of the other jaw 22. At the point where the longitudinal seam 9 of the bag package 1 contacts them, preferably no openings are provided (see FIG. 2). The suction openings 28, 29 belong to bores 30 in the lower wall of the jaws 11, 12, which communicate by a respective distributor conduit 31, 32 via a switch valve with a vacuum source. To limit the pressing together of the jaws 11, 12, a set screw 35 is disposed laterally on one jaw 11 and a stop dog 36 is disposed laterally on the other jaw 12.

The two hollow spaces 17, 18 in the jaws 11, 12, when the jaws are closed, form a chamber into which a connection 37 communicating with a vacuum source via a switch valve discharges through the jaw 12. Two sealing jaws 41, 42 heated with heating elements 38, 39 are disposed directly opposite each other, in the lower part of the hollow spaces 17, 18; one of these sealing jaws 42, is resiliently secured in the jaw 12, and the other sealing jaw, 41, is movable and pressable toward the first jaw 42 by a pneumatic work cylinder 43. The movable sealing jaw 41 normally assumes a retracted position, from which it is displaced toward the other sealing jaw 42 in order to seal the top closure 2 of the bag package 1 subsequent to evacuation of the filled bag.

The bag evacuating and closing apparatus described above functions as follows:

As already mentioned, a bag package 1 to be handled is moved to beneath the two jaws 11, 12, which are apart from one another, and is raised with the bottom plate 15, so that its shoulders 3 rest resiliently on the underside of the jaws 11, 12. Next, the two jaws 11, 12 are displaced toward one another until the set screw 35 on the jaw 11 strikes the stop dog 36 on the other jaw 12. In this position, the soft sealing rib 25, which is offstanding from the face end of the frame 21 of one jaw 11, rests sealingly on the face end of the frame 22 of the other jaw 12. The end portions of the sealing rib 25 in the lower frame part 23 also press the two side regions having the side folds 7, 8 of the top closure 2 of the bag package 1 together. By applying a vacuum to the suction openings 28, 29, the two walls 5, 6 of the top closure 2 of the bag package 1 are pulled toward the face end of the lower frame parts 23, 24 in the region of the suction openings 28, 29, so that a channel that connects the interior of the bag to the chamber formed by the hollow spaces 17, 18 is formed in the gap between the two lower frame parts 23, 24 where there is no sealing rib, in the top closure 2 between the two walls 5, 6 thereof, and that furthermore the top closure 2 of the bag package 1 is tightly closed off from the ambient atmosphere. In this position, the chamber is connected to the vacuum source, and gas and air are aspirated from the bag package 1. After a period of from 0.2 to 1 second, the movable sealing jaw 41 is displaced toward the other sealing jaw 42, so that under the influence of heat and pressure a sealing seam is formed in the top closure 2. After that, the chamber is vented through bores 43, 44 which discharge into the hollow spaces 17, 18 above the sealing jaws 41, 42, and finally the jaws 11, 12 are retracted to their outset position. The evacuated and closed bag package 1 is then removed and the next one is delivered.

It should additionally be noted that the part of the frame of the jaws in which the suction openings for keeping the closure fold of the bag package open are disposed may preferably be concave, so that the walls of the bag package upon being pulled apart are made taut. The disposition of the suction openings can also be made such that they also extend in the region of the side folds of the bag closure fold, with the sealing rib then extending only a few millimeters into the lateral region of the bag closure fold.

The exemplary embodiment of the invention described above and shown in the drawings is preferably suitable for handling bags with a side fold. With suitable adaptation, such an apparatus is also suitable for other bag types, such as tubular bags, flat bags and those with a closure that is drawn flat. The longitudinal seam may also be located at some other point on the bag package.

The foregoing relates to a preferred exemplary embodiment of the invention, it being understood that other variants and embodiments thereof are possible within the spirit and scope of the invention, the latter being defined by the appended claims.

What is claimed and desired to be secured by letters patent of the United States is:

1. An apparatus for evacuating and closing commodity filled bag packages, each of said bag packages include a commodity filled body and a flat folded upper end portion of superposed heat sealable walls (5, 6) offstanding from shoulders of the body, said apparatus including a pair of movable evacuatable jaws (11, 12) that can be moved towards and away from each other and be pressed tightly toward one another to form a chamber between them which is connectable to a vacuum source, which chamber receives and encompasses the upper end portion of said bag portion, said pair of jaws including suction openings (28, 29) that cover parts of the upper end portion of the bag package received in said chamber, suction means connected with aid suction openings for suction pulling the walls of the upper end portion of the bag slightly apart from each other for extraction of air or gas from the bag package by suction, a pair of oppositely disposed sealing jaws (41, 42) within said chamber formed by said pair of movable jaws that can be pressed against the upper end portion of the bag package near a rim of the upper end portion of the bag package for providing a sealing seam on the upper end portion, said sealing jaws (41, 42) are disposed in hollow spaces (17, 18) of the jaws (11, 12), said hollow spaces (17, 18) of the jaws (11, 12) are surrounded by frame portions (21, 22) oriented toward one another; said suction openings (28, 29) are disposed in frame parts (23, 24) of the frame portions (21, 22) located near the shoulders (3) of the bag package (1); and a resilient sealing rib (25) for separating said chamber from the atmosphere that protrudes from one of said frame portions (21) and surrounds said chamber excluding the frame part (23) with the suction opening (28) of one (11) of said pair of jaws, said resilient sealing rib (25) protrudes toward the frame portion (22) of the other (12) of said pair of jaws.

2. An apparatus as defined by claim 1, in which the suction openings (28, 29) are disposed only in a middle region of the frame parts (23, 24) of the jaws (11, 12) located near the shoulders (3) of the bag package (1).

3. An apparatus as defined by claim 2, in which said bag package (1) has a longitudinal seam (9) that extends in a wall (6) of the bag closure (2) transversely to the length of said wall, and the region of the frame part (23) of the jaw (11) contacting this longitudinal seam is free of any suction openings.

4. An apparatus as defined by claim 1, in which the regions of the frames (21, 22) of the jaws (11, 12) in which the suction openings (28, 29) are disposed are embodied as concave.

5. An apparatus as defined by claim 2, in which the regions of the frames (21, 22) of the jaws (11, 12) in which the suction openings (28, 29) are disposed are embodied as concave.

6. An apparatus as defined by claim 3, in which the regions of the frames (21, 22) of the jaws (11, 12) in which the suction openings (28, 29) are disposed are embodied as concave.

7. An apparatus as defined by claim 1, which includes a device (15) which lifts a bag package (1) associated with the jaws (11, 12), and that the jaws (11, 12) and the device (15) are movable relative to one another so that the bag package is pressed resiliently with its shoulders (3) against the underside of the jaws (11, 12).

8. An apparatus as defined by claim 2, which includes a device (15) which lifts a bag package (1) associated with the jaws (11, 12), and that the jaws (11, 12) and the device (15) are movable relative to one another so that the bag package is pressed resiliently with its shoulders (3) against the underside of the jaws (11, 12).

9. An apparatus as defined by claim 3, which includes a device (15) which lifts a bag package (1) associated with the jaws (11, 12), and that the jaws (11, 12) and the device (15) are movable relative to one another so that the bag package is pressed resiliently with its shoulders (3) against the underside of the jaws (11, 12).

10. An apparatus as defined by claim 4, which includes a device (15) which lifts a bag package (1) associated with the jaws (11, 12), and that the jaws (11, 12) and the device (15) are movable relative to one another so that the bag package is pressed resiliently with its shoulders (3) against the underside of the jaws (11, 12).

11. An apparatus as defined by claim 5, which includes a device (15) which lifts a bag package (1) associated with the jaws (11, 12), and that the jaws (11, 12) and the device (15) are movable relative to one another so that the bag package is pressed resiliently with its shoulders (3) against the underside of the jaws (11, 12).

12. An apparatus as defined by claim 6, which includes a device (15) which lifts a bag package (1) associated with the jaws (11, 12), and that the jaws (11, 12) and the device (15) are movable relative to one another so that the bag package is pressed resiliently with its shoulders (3) against the underside of the jaws (11, 12).

* * * * *